United States Patent [19]

Duverne

[11] 4,419,847

[45] Dec. 13, 1983

[54] DEVICE FOR SUPPORTING AND MOVING A TOOL WITHIN A TAPPING

[75] Inventor: Jean-Benoit Duverne, Le Creusot, France

[73] Assignee: Framatome, Courbevoie, France

[21] Appl. No.: 251,456

[22] Filed: Apr. 6, 1981

[30] Foreign Application Priority Data

Apr. 15, 1980 [FR] France ..... 80 08430

[51] Int. Cl.[3] ..... B24B 5/06

[52] U.S. Cl. ..... 51/90; 51/43; 51/241 S; 51/245; 51/290; 409/179; 409/199; 15/104.1 R

[58] Field of Search ..... 51/33 R, 35, 43, 47, 51/73, 90, 99, 103 R, 103 C, 105 R, 227 R, 241 R, 241 S, 241 B, 241 VS, 241 A, 245, 261, 281 P, 290; 15/104.09, 104.1 R, 104.1 C, 104.11; 409/139, 140, 143, 178, 179, 191, 199

[56] References Cited

U.S. PATENT DOCUMENTS

| | | | |
|---|---|---|---|
| 1,114,376 | 10/1914 | Milkop | 51/43 |
| 1,365,149 | 1/1921 | Breed | 51/245 |
| 1,814,078 | 7/1931 | Cole et al. | 51/245 |
| 2,188,720 | 1/1940 | McQuade | 51/241 B |
| 2,297,074 | 9/1942 | Rohrdanz | 51/241 B |
| 2,372,341 | 3/1945 | Shanley | 51/241 A |
| 2,521,210 | 9/1950 | Fulmer | 51/245 X |
| 3,218,762 | 11/1965 | Renfroe | 51/245 |
| 4,208,229 | 6/1980 | Giardini | 51/283 R X |

*Primary Examiner*—Frederick R. Schmidt
*Assistant Examiner*—Robert P. Olszewski
*Attorney, Agent, or Firm*—Pollock, Vande Sande & Priddy

[57] ABSTRACT

A supporting and centering arrangement in the form of a star the arms of which are radial with respect to a tapping to be machined or checked. These arms have elements for centering and fastening them to the tapped wall, as well as a centering element at the projecting end of the tapping. The support and the centering element carry bearings. A tool holder bar connected to two rotating stub shafts is mounted off-set from the axis of the bearings in the radial direction of the tapping. The bar supports a tool guide, and is rotatable about the axis of the tapping. The device is especially useful for machining and checking tappings formed in a pressurized water nuclear reactor tank.

5 Claims, 6 Drawing Figures

1
6
20
21
2'
3'
7a
47
30
X
X'
51
9
50
8
46
21b
20b
1b
1a

DEVICE FOR SUPPORTING AND MOVING A TOOL WITHIN A TAPPING

SUMMARY OF THE INVENTION

The invention relates to a device for supporting and moving a tool within a tapping traversing a wall so as to be flush on one side of the wall and projecting on the other side.

BACKGROUND OF THE INVENTION

In heavy components made in boiler factories, in particular pressurized water nuclear reactor vessels, pipe outlets or inlets in the tank or tappings are formed in the wall of the vessel so as to permit the connection, outside of this vessel, between the tapping and an inlet or outlet pipe.

Such tappings are formed in the wall so that the tapping is flush with the inner surface of the tank and projects fairly widely outside the tank to connect it with a pipe of the primary circuit of the reactor bringing water under pressure into the tank, or enabling the outflow of this water, which acts as coolant in the core of the reactor, from the vessel to the steam generators.

The inner surface of the vessel as well as of the tappings must be coated with a layer of stainless steel, and the quality of this coating must be checked, in particular within tappings formed in the wall of the tank.

Such checks assume a very good surface condition of the coating, and the entire inner surface of the tapping must be milled before commencing the checking operation.

On the other hand, when defects are detected, it is necessary to carry out machining in greater depth in order to determine the depth of these defects.

To carry out the machining operations or the checking operations, a tool or a checking means must be moved inside the tapping into different positions, enabling the various areas of the lateral surface of the tapping to be reached.

In the case of pressurized water reactor vessels, the borings or checks inside the tappings of the primary circuit are generally performed when the vessel is in vertical position, i.e., with tappings whose axes are practically horizontal.

To date, these operations are performed manually and are extremely arduous since it is necessary to work with very different positions of the tool although the internal diameter of the tapping is relatively small.

In the same way, the sound execution of the work inside the tapping is hampered by limited accessibility, the internal diameter of the tapping being relatively small. In certain cases, the space available is not even sufficient to permit the use of certain types of tools.

In addition, tappings of pressurized water inlet pipes in the vessel of the reactor have a conically shaped bore which further complicates manual machining for the purpose of achieving a good surface condition.

More generally, when it is desired to carry out machining or checking operations in tappings formed in the wall of a large sized boiler-made component, difficulties are encountered due to the exiguity of the space within which the machining is to be done, to the various positions that the tool or the checking means must be made to assume to follow the inner surface of the tapping, and to the fact that the inner bore of these tappings is not always cylindrical.

It is therefore an object of the invention to provide a device for supporting and moving a tool within a tapping having a symmetry of revolution and traversing a wall so as to be flush on one side of the wall and project on the other side, this device enabling automatisation of the work carried out with the tool, and accurate positioning of the tool with respect to the surface to be worked inside the tappings.

It is another object of the invention to provide a device for supporting and moving a tool within a tapping which device is adaptable to different types of profile and to different bore sizes.

GENERAL DESCRIPTION OF THE INVENTION

Accordingly, the device according to the invention comprises:

(a) means for supporting and centering in the form of a star the arms of which are radial with respect to the tapping and bear centering parts designed to be engaged in the orifice of the tapping and means for fixing to the wall, on the flush side of the tapping;

(b) a centering part at the projecting end of the tapping and within the latter;

(c) the supporting means and the centering part carrying end bearings having the axis of the tapping for a common axis, (d) a tool holder bar connected to two stub shafts aligned along the axis of the tapping, each rotating in one of the end bearings and mounted off-set with respect to the axis of the tapping in a radial direction, (e) means for rotating the tool holder bar around the tapping axis; and (f) means for guiding and moving a tool in the axial direction and in radial directions of the tapping, borne by the tool holder bar.

In order that the invention may be more clearly understood an embodiment thereof will now be described by way of example, with reference to the accompanying drawings, in the case where the supporting and moving device according to the invention is used for machining and checking in tappings of a pressurized water nuclear reactor vessel.

BRIEF INTRODUCTION TO THE DRAWINGS

DESCRIPTION OF PREFERRED EMBODIMENT

Figure 1:
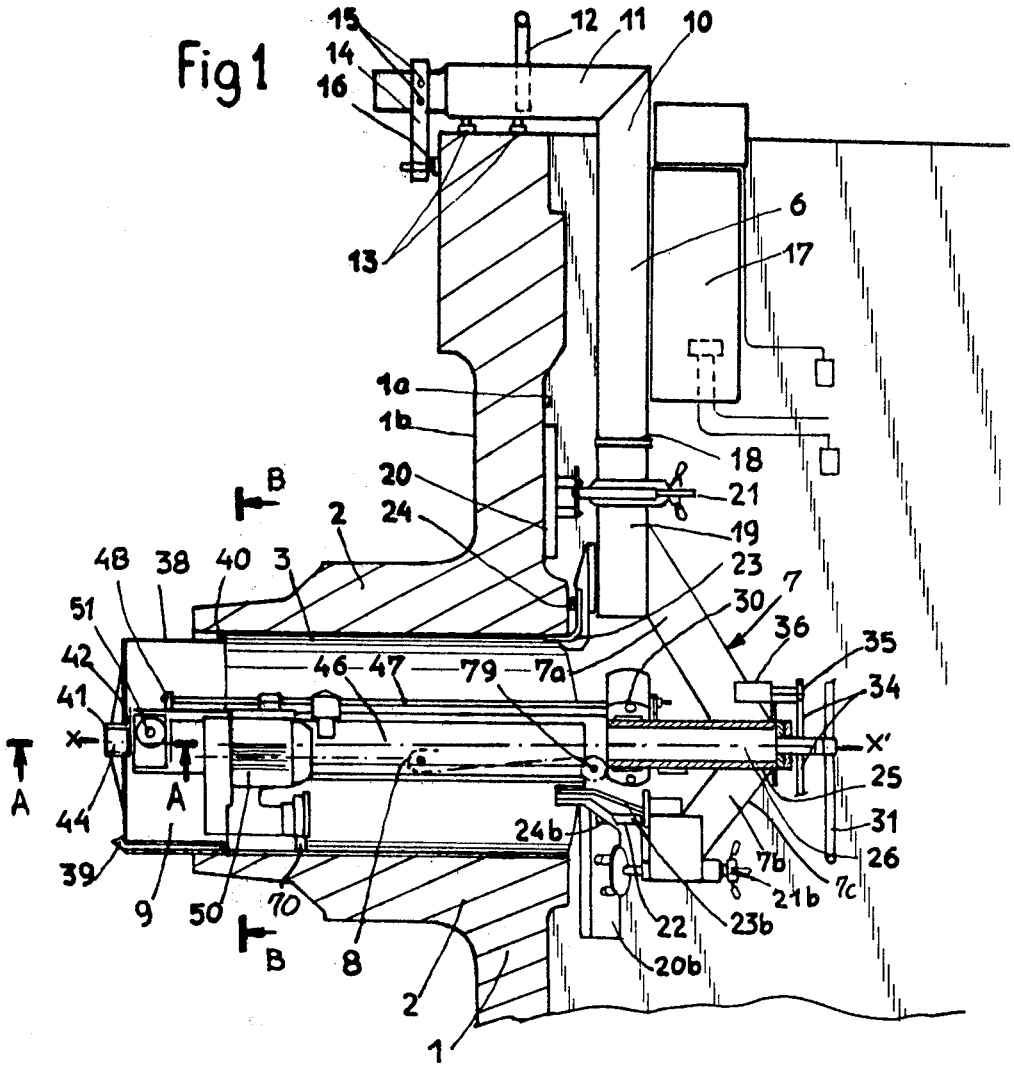
FIG. 1 is an elevation, partly in section, of the whole of the device in position within the cylindrical bore of a tapping formed in the wall of a pressurized water nuclear reactor vessel.

FIG. 1 shows a portion of the wall 1 of a pressurized water reactor vessel having a tapping 2 which is practically flush with the inner surface 1*a* of the wall 1 of the vessel, and which projects with respect to the outer wall 1*b* of this vessel.

The inner bore 3 of the tapping 2 is cylindrical.

The supporting and moving device for a milling tool in the bore of the tapping shown in FIG. 1 includes a handling frame 6, a star-shaped support 7, a tool holder bar 8 and a centering bell 9.

The handling frame is constituted by a bracket formed by two beams 10 and 11 of rectangular section, the beam 10 being positioned vertically and the beam 11 horizontally when the device is in position inside the vertical tank 1.

The horizontal beam 11 bears a handling lug 12 enabling the transportation of the device as a whole with a travelling bridge crane. This beam 11 is supported on the upper portion of the vessel 1 through two supports 13 constituted by screws enabling adjustment of the verticality of the handling frame positioned on the vessel. Means for attaching the handling frame on the tank are provided at the end of the beam 11, and comprise an arm 14 held in position at the end of the beam 11 by pins 15 inserted in openings of arm 14.

A screw 16 enables the handling frame to be locked in position on the upper portion of the tank. The handling frame 6 also carries an electrical box 17 enabling the supply of the drive members of the device.

The handling frame 6 is connected to the star-shaped supporting device 7 by bolting at the level of a junctions plate 18 assuring the connection between the lower end of the handling frame and one of the arms of the star-shaped support 7 which is constituted by three arms *7a, 7b, 7c* each having, as its plane of symmetry, a plane containing the axis xx' of the tapping, i.e., radial planes.

The arms *7a, 7b, 7c* are inclined to the vertical and radial with respect to the tapping when the device is in position as shown in FIG. 1.

The arm *7a* is constituted at its end by a beam portion 19 enabling its coupling with the frame 6. This beam portion 19 bears a suction disc 20 whose position is adjustable with respect to the arm *7a* by means of a screw 21. The beam 19 also carries a centering bracket 23 engageable in the orifice of the bore 3 flush with the inner surface 1*a* of the tank, this bracket itself bearing a stub 24 enabling support on the inner surface 1*a* of the vessel.

In the same way, the arms *7b* and *7c* include respectively adjustable suction discs and support brackets to permit the centering and attachment of the device to the inner surface of the vessel at the level of the tapping. The stubs associated with the arms *7b* and *7c*, respectively, are adjustable by means of the jacks 22.

At the center of the star is fixed a bearing 25 in which rotates the shaft 26 axially positioned with respect to the tapping. The shaft 26 is connected to the tool holder bar 8 by means of a device 30 enabling adjustment of inclination, and to be described in more detail with reference to FIGS. 3 and 4.

At the end of the shaft 26 is fixed a wheel 31 enabling the shaft 26 to be rotated manually from a derrick floor within the vessel.

The end of the shaft 26 is also fast to a gear-wheel 34 engaging with a pinion 35 driven by a motor 36 supported by the arm *7a* of the star.

The centering bell 9 inserted in the projecting end of the tapping comprises a cylindrical jack 38 bearing on its outer surface sliding pads such as 39 facilitating the insertion of the centering bell into the tapping, and inflatable seal 40 positioned within a groove machined in a projecting portion of the outer surface of the bell 38.

At the central part of the cylindrical envelope 38 of the bell is fixed a bearing 41 constituted by a tube made fast to the bottom of the bell 38 by ribs 42.

Figure 2:
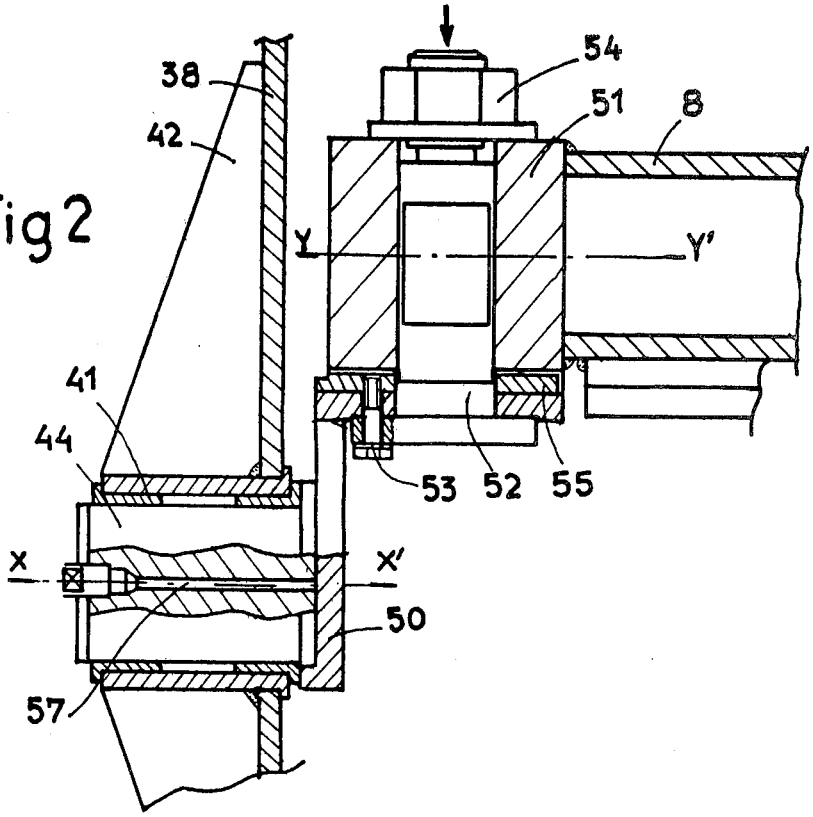
FIG. 2 is an enlarged section along the line A—A of FIG. 1.

In the bearing 41 is engaged a shaft 44 connected in articulated manner to the end of the tool holder bar 8, as will be explained with reference to FIG. 2. The shafts 26 and 44 are aligned and positioned axially with respect to the tapping, i.e., in the case of FIG. 1, in a horizontal direction.

The tool holder bar 8 is provided over its whole length with a slide 46 with a dovetailed profile and a screw 47 mounted in bearings such as 48 permitting the movement of the tool 70 constituted by a grinding wheel and its driving motor in the axial direction of the tapping.

The tool will be described in more detail with reference to FIG. 2, which shows the pivoting axle 44 inside the bearing 41 positioned at the center of the cylindrical bell 38 in axial direction.

The shaft 44 is fast to a bracket 50 whose horizontal part enables fixing of the tool holder bar 8 in a precise position as regards its orientation with respect to the shaft 44. For this, the bar 8 is fast to a sleeve 51 in the central bore through which passes an axle 52 fixed with respect to the bracket by means of screws 53 and with respect to the sleeve 51 by a nut 54 engaged on the threaded upper end of the shaft 52. Openings in the sleeve 51 and cotters 55 enable the bar 8 to be held in a constant angular position with respect to axial shaft 44, if one considers a rotation around the axle 52.

In all cases, the longitudinal axis yy' of the tool holder bar 8 is radially off-set with respect to the axis xx' of the tapping.

The shaft 44 is pierced at its center by a passage 57 enabling the supply of control fluid to the inflatable seal 40.

Figure 3:
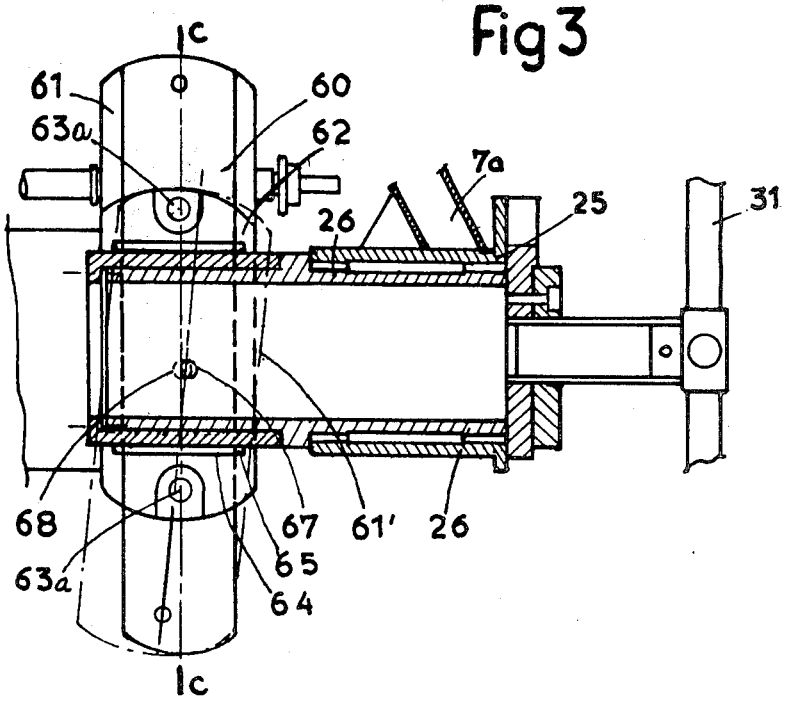
FIG. 3 is a view on a larger scale of the right-hand portion of FIG. 1.
Figure 4:
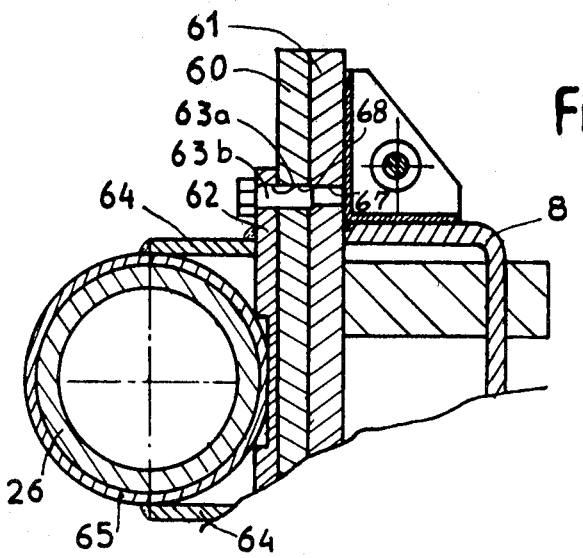
FIG. 4 is a section along the line C—C of FIG. 3.

FIGS. 3 and 4 show axial shaft 26 mounted to rotate in the bearing 25 and connected through a sleeve 65 and stiffeners 64 to a plate 62, the stiffeners 64 being welded on the one hand to the sleeve 65 and on the other hand to the plate 62.

The plate 62 comprises two holes 63*a* within which pass screws 63*b* enabling the shaft 26 and the tool holder bar 8 to be fastened together.

The tool holder bar 8 is fast to an attachment plate 61, whereas a support plate 60 is inserted between the plate 62 fast to the shaft 26 and the plate 61 fast to the tool holder bar 8.

The support plate 60 is pierced with holes 68 centered on the vertical axis of this plate 60.

The concordance between the holes 63*a* and 68 enables the plates 60 and 62 to be made fast through screws 63*b*.

The plate 61 fast to the tool holder bar 8 comprises sets of two threaded holes 67 the spacing of which corresponds to that of the holes 63*a* of the plate 62.

In FIG. 3 a first set of holes 67 of the plate 61 is shown in concordance with the holes 63*a* and 68, so that the screws 63*b* permit the shaft 26 and the tool holder bar to be fastened together, whereby the axis of this bar is parallel with the axis of the shaft 26, i.e., with the axis of the tapping.

This corresponds to the position of the tool shown in FIG. 1 where the rotational positioning of the axle 26 through the gear wheel 34 enables the mill of the tool 70 to be made to describe the internal cylindrical surface of the bore of the tapping 2.

The second set of holes 67, when brought into concordance with the holes 63*a* and 68, enables the plate 61 to be placed in the position 61' shown in dot-dash lines in FIG. 3. For this, it suffices to unscrew the screw 63*b* and to move the plate 61 fast to the tool holder bar 8 downwards, then to rotate it slightly to bring the holes 67 into concordance with the holes 63*a* and 68. The shaft 26 and the tool holder bar 8 can then be fastened together by means of the screws 63*b* which have just been fixed in the second set of holes 67 of the plate 61.

The axis of the tool holder bar 8 is then inclined with respect to the axis of the shaft 26, i.e., with respect to the axis of the tapping 2.

Figure 6:
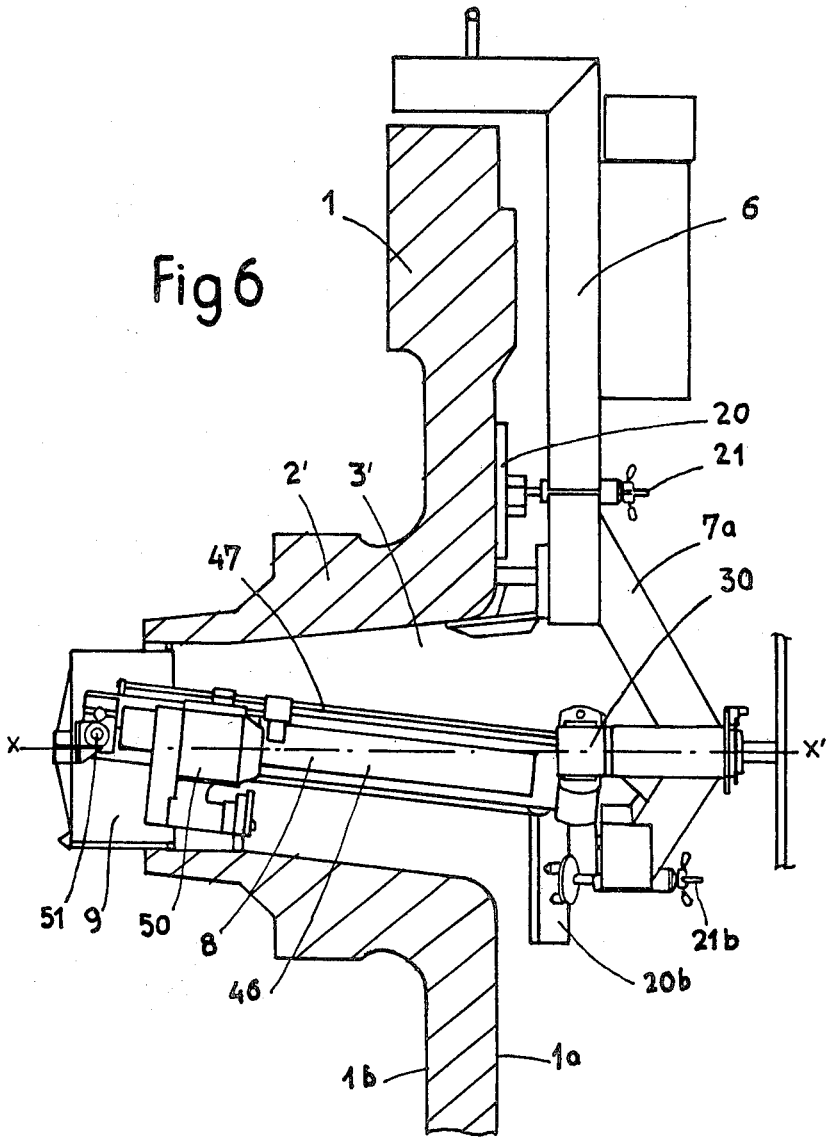
FIG. 6 is an elevation, partly in section, of the whole of the device in position in a conically shaped bore of a tapping formed in the wall of a pressurized water reactor tank.

The device is then in the position shown in FIG. 6.

The arrangement of two sets of holes 67 on the plate 61 is selected so as to bring the axis of the tool holder bar along the direction of a generator of the cone constituting the bore of the tapping 2' shown in FIG. 6.

In fact, in pressurized water nuclear reactor vessels the tappings are of two types, some with an inner cylindrical bore, others with a conical inner bore. With a plate including two sets of holes 67 as shown, it is hence possible to move the device very rapidly and very easily from the machining position in a cylindrical bore to the machining position in a conical bore.

In fact, on the placing in rotation of the shaft 26, the grinding wheel of the tool 70 can then describe a conical surface corresponding to the inner surface of the bore.

Figure 5:
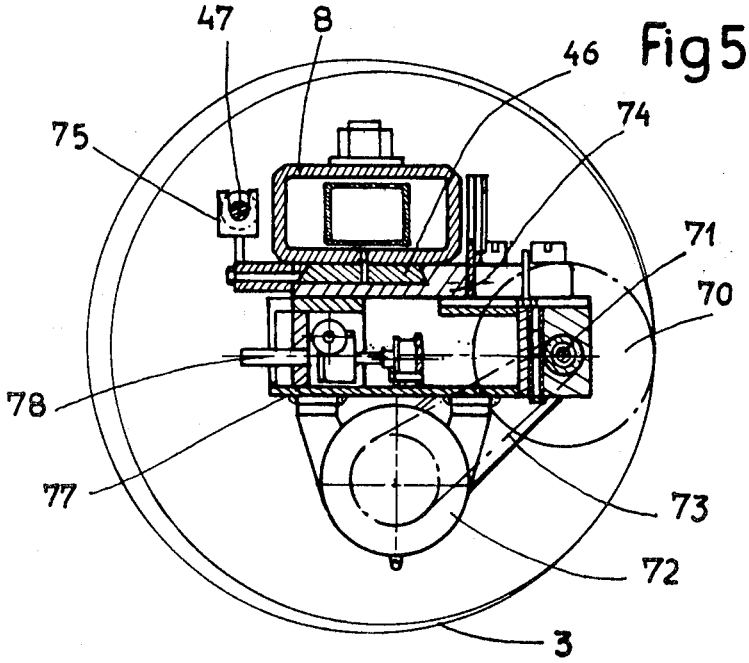
FIG. 5 is a section along the line B—B of FIG. 1.

Referring to FIGS. 1 and 5, the whole of the tool is seen constituted by a grinding wheel 70 mounted on an axle 71 driven by a motor 72 through a belt 73.

The whole of the tooling is fixed to a frame 74 mounted to slide on the dovetailed slide 46 fast to the tool holder bar 8. On the other hand, the frame 74 bears a nut 75 in engagement with the endless screw 47 rotated by a motor supported by the tool holder bar 8.

In this manner, the whole of the tooling can be moved axially in the bore by being moved along the slide 46 of the tool holder bar 8.

The axle 71 of the grinding wheel 70 is rotatably mounted in a barrel 77 which can be moved along its axis by a jack 78, with respect to the frame 74 of the tooling. This effects penetration of the grinding wheel into the covering metal of the bore of the tapping.

A set of pulleys 79 permits the electric wires or fluid supply tubes to reach the different motors or jacks supported by the tool holder bar and the tooling.

To place the supporting and moving device which has just been described in service, the various adjustments enabling it to be adapted to the tapping to be machined are first made.

Thus, the brackets 23 are adjusted to the aperture of the tapping, a bell 38 of a diameter corresponding to the inner diameter of the tapping is selected and the inclination of the tool holder bar 8 with respect to the rotary axis of this bar is selected so as to be adapted to the geometry of the tapping. A tool suitable for the machining to be done is placed on the tool holder bar.

Once these adjustments have been made, the tool is placed in raised position and the suction cups in their rear position.

The device is then inserted into the tapping by handling it by means of the lifting lug 12 until the bell is in its final position at the level of the end of the projecting portion of the tapping. The stubs 24 are placed in position against the inner wall of the vessel and the seal 40 of the bell 28 is inflated by sending the actuating fluid for the seal through the central passage 57 of the shaft 44.

Then the adjustment in position and the fixing of the tool is carried out by means of the shaft 14 and by the screws 12 and 16.

The suction cups 20 are then adjusted by acting on the screws 21 so that these suction discs contact the inner wall of the vessel. These suction discs 20 have a contact surface constituting a portion of a cylinder, so as to enable them to mate perfectly with the inner surface of the tank.

The suction discs are then subjected to suction, which permits the device to be held in position independently of any other support. Then the working parameters of the tool are selected which is started up from a control box arranged on the portion of the device which is inside the tank.

If it is desired to true the entire inner surface of the tapping, the grinding wheel can be advanced step by step in the axial direction and the tool holder bar rotated slightly over 360° so as to effect a complete sweep of the surface with a slight overlap. Each of the step by step advances is obviously selected so that its amplitude is less than the operating width of the grinding wheel.

In this case, after the positioning of the tool and the placing of the suction discs 20 under reduced pressure, the centering brackets 23 are dismounted, permitting a sweep of the inner surface of the tapping by the grinding wheel up to the end of this tapping flush with the inner surface of the tank.

The principal advantages of the device according to the invention are to enable automatisation of the operations of machining in a tapping and the use of more bulky tools, to provide high power at the shaft end and to permit adaptation to various geometries of tapping.

On the other hand, in the case of trueing the inner surface of the tapping with a grinding wheel, the regularity of the milling compared to manual milling results in a surface of very high quality.

It is also possible to completely isolate the tapping during the operations which are carried out then by means of inflatable seals of the centering bell.

Finally, the use of the device according to the invention is particularly simple and accurate.

The invention is not limited to the embodiment which has just been described, but encompasses all modifications and the use of equivalent means.

Thus, instead of using a grinding wheel for trueing the tapping, it is possible to use an abrasive belt passing over a pulley and a support wheel rotated by a motor.

Instead of a milling tool, it is possible to arrange on the tool holder bar a tooling enabling any operation to be carried out at any location within the tapping bore.

It is also possible to use fastening means other than suction discs attached against the inner wall where the tapping opens out, and to use other embodiments of the device for variable inclination of the tool holder bar.

The use of the device according to the invention is not limited to machining, but may also be used to carry out non-destructive checking within a tapping by replacing the tool mounted on the tool holder bar by checking means which can be moved into positions enabling the checking of the entire inner surface of the bore.

Finally, the device according to the invention may be employed in fields other than the construction of nuclear reactor vessels, e.g., in the construction of other forged or boiler-made vessels of large dimensions including tappings of any shape.

I claim:

1. Device for supporting and moving a tool within a substantially horizontal tapping having a symmetry of revolution and traversing a wall so as to be flush with one side of said wall and project from the other side of said wall, said device comprising (a) supporting and centering means in the form of a star, the arms of which extend radially with respect to the tapping;

(b) centering members carried by said arms for engagement within said tapping;

(c) means for fastening to the wall on the flush side of the tapping supported by the ends of said arms remote from said tapping;

(d) a cylindrical centering bell at the projecting end of said tapping and within the latter, said bell supporting a fluid-tight seal on its outer surface;

(e) end bearings carried by said supporting means and said centering bell, said end bearings having an axis common with the axis of said tapping;

(f) a tool holder bar connected at its ends to two stub shafts aligned along the axis of said tapping, each of said stub shafts being rotatable in one of said end bearings, said tool holder bar being off-set with respect to the axis of said tapping in a radial direction;

(g) means for rotating said tool holder bar about the axis of the tapping; and (h) means carried by said tool holder bar for guiding and moving a tool in axial direction and in radial directions of the tapping.

2. Supporting device according to claim 1, wherein said tool holder bar is connected to said stub shafts through devices enabling orientation of said tool holder bar either parallel to the axis of said tapping or in at least one direction inclined with respect to this axis to cause said tool to describe a conical surface during rotary movements of said tool holder bar and axial movements of said tool.

3. Supporting device according to claim 2, wherein the tool holder bar is connected to the stub shaft mounted in the bearing fast to the centering part through an axle perpendicular to the axis of this bearing enabling the orientation of the tool holder bar with respect to the axis of the bearing and to the stub shaft mounted in the bearing connected to the star-shaped support through fastening plates, one borne by the tool holder bar, the other by the stub shaft of which one at least comprises at least two sets of fastening holes by means of screws for obtaining two different inclinations of the tool holder bar with respect to the stub shafts aligned along said tapping axis.

4. Supporting device according to any one of claims 1 to 3, wherein the start-shaped support is connected to a bracket-shaped handling and supporting frame which can rest on the upper portion of the wall traversed by the tapping.

5. Device according to any one of claim 1 to 3, wherein the fastening means for the star-shaped support to the wall on the flush side of the tapping are constituted by suction discs.

* * * * *